United States Patent [19]

Schellhamer et al.

[11] Patent Number: 4,715,931

[45] Date of Patent: Dec. 29, 1987

[54] PROCESS FOR INHIBITING ALUMINUM HYDROXIDE DEPOSITION IN PAPERMAKING FELTS

[75] Inventors: Alan J. Schellhamer; Daniel J. Barnett; Abdul Q. Khan, all of Jacksonville, Fla.

[73] Assignee: Betz Laboratories, Inc., Trevose, Pa.

[21] Appl. No.: 29,827

[22] Filed: Mar. 24, 1987

[51] Int. Cl.[4] ..... D21F 1/32

[52] U.S. Cl. ..... 162/199

[58] Field of Search ..... 162/199, DIG. 4; 134/15, 32, 38, 39, 40, 41

[56] References Cited

U.S. PATENT DOCUMENTS

| | | |
|---|---|---|
| 210,690 | 12/1878 | Hawke . |
| 2,017,640 | 10/1935 | Ubbelohde . |
| 2,110,032 | 3/1938 | Williams . |
| 2,312,710 | 3/1943 | Gordon . |
| 2,692,183 | 10/1954 | Ericks . |
| 2,703,279 | 3/1955 | Bate et al. . |
| 3,071,504 | 1/1963 | Dunklin et al. . |
| 3,226,179 | 12/1965 | Manasian et al. . |
| 3,292,992 | 12/1966 | Manasian . |
| 3,306,810 | 2/1967 | Buckman et al. . |
| 3,398,047 | 8/1968 | Michalski . |
| 3,406,089 | 10/1968 | Yerkes, Jr. . |
| 3,573,089 | 3/1971 | Tate . |
| 3,630,830 | 12/1971 | Herdle et al. . |
| 3,652,386 | 3/1972 | Noreus et al. . |

FOREIGN PATENT DOCUMENTS 929971 6/1963 United Kingdom .

OTHER PUBLICATIONS

"Cleaning and Conditioning of Papermakers Felts", Shannon V. West, Southern Pulp and Paper Manufacturer, Sep. 10, 1968, pp. 60, 62.

"The Case for Continuous Cleaning of Felts", David G. Elliott and James L. Hanchette, Southern Pulp and Paper Manufacturer, Jun. 10, 1963, pp. 43–44, and 46.

"Felt Conditioner Applications", Betz PaperChem Pulp and Paper Reference Manual, 1983, Section 6.1, pp. 1–4.

*Primary Examiner*—Peter Chin

*Assistant Examiner*—Thi Dang

*Attorney, Agent, or Firm*—Alexander D. Ricci; Bruce E. Peacock; James D. Dee

[57] ABSTRACT

This invention relates to process for inhibiting deposition of aluminum hydroxide in felts of a papermaking system which comprises adding to the felts an effective inhibiting amount of a hydroxylated carboxylic acid having at least 1 hydroxyl group and at least 2 carboxyl groups. The molecular weight of the carboxylic acid is from about 100 to about 200 and, preferably, the carboxylic acid is selected from the group consisting of tartaric acid, malic acid, citric acid, mesoxalic acid, tartronic acid and tetrahydroxy succinic acid. The use of these carboxylic acids in combination with surfactants provides an especially effective aluminum hydroxide inhibiting and total felt conditioning process when both components are applied to the felt.

18 Claims, No Drawings

PROCESS FOR INHIBITING ALUMINUM HYDROXIDE DEPOSITION IN PAPERMAKING FELTS

BACKGROUND OF THE INVENTION

1. Field of the Invention

This invention relates to inhibiting deposition of aluminum hydroxide in felts of a papermaking system. More particularly, this invention relates to inhibiting aluminum hydroxide deposition in a felt in a press section of a papermaking system wherein the felt is prone to such deposition and the felt is conditioned by showering with an aqueous medium.

2. Description of the Prior Art

When fresh, untreated shower water is utilized for conditioning of press felts on papermaking machines producing paper or paperboard from pulp suspensions containing alum (aluminum sulfate), and the resulting pH of the white water/fresh water mixture in the felts falls in the approximate range of 4.8–8.0, a sufficient quantity of insoluble aluminum hydroxide can precipitate alone or in conjunction with other substances from the white water and cause the felts to become prematurely filled and compacted. This results in reduced paper machine productivity and/or the need to prematurely remove the felts from the machine, the latter leading to increased operating costs and increased lost production time.

This problem of aluminum hydroxide deposition has been overcome historically by treatment of the shower water with strong acids such as sulfuric or phosphoric acid fed from bulk supply or in the form of specialty felt conditioning products. The purpose of the strong acid is to reduce the shower water pH to a level at which aluminum hydroxide will not precipitate, which is typically around a pH range of 4.0–4.5. However, this approach has several disadvantages. For example, when the shower water is especially alkaline, large quantities of acid or acid-based felt conditioning product is required which can be both costly and dangerous. Also, the acidic shower water causes accelerated corrosion of the shower piping, nozzles, and other parts of the felt conditioning system. Additionally, recent studies conducted by the present inventors have shown that the pH range of approximately 5.5–7.0 is more optimum for the performance of the most effective surfactants utilized as felt conditioning agents to inhibit felt filling and compaction caused by tacky wood pitch components or rosin size.

Effective chemical conditioning of a press felt helps to reduce the rate of felt compaction, maintain maximum felt absorbency, and prolong the felt's useful operating life. A felt must be kept clean of filling materials that adhere to the felt fibers and accumulate in the felt structure. These filling materials not only impede the flow of water through the felt, but also create adhesion between felt fibers, thus increasing the tendency for the felt's structure to compact and lose absorption capacity. Effective felt conditioning is particularly important for high synthetic fiber content felts which are seldom removed because they are worn out. They are generally removed because they become filled and compacted to the point where adequate absorption capacity is lost.

SUMMARY OF THE INVENTION

This invention relates to processes for inhibiting deposition of aluminum hydroxide in felts of a papermaking system which comprises adding to the felts an effective inhibiting amount of a hydroxylated carboxylic acid having at least 1 hydroxyl group and at least 2 carboxyl groups. The molecular weight of the carboxylic acid is from about 100 to about 200 and, preferably, the carboxylic acid is selected from the group consisting of tartaric acid, malic acid, citric acid, mesoxalic acid, tartronic acid and tetrahydroxy succinic acid. The use of these carboxylic acids in combination with surfactants known in the art for controlling organic contaminants in the felt, such as pitch components or rosin size, provides an especially effective aluminum hydroxide inhibiting and total felt conditioning process when both components are applied to the felt.

Accordingly, it is an object of the present invention to provide processes for inhibiting deposition of aluminum hydroxide in felts of a papermaking system. It is a further object of this invention to inhibit aluminum hydroxide deposition in a felt in a press section of the papermaking system wherein the felt is prone to such deposition and the felt is conditioned by showering with an aqueous medium. These and other objects and advantages of the present invention will be apparent to those skilled in the art upon reference to the following description of the preferred embodiments.

DESCRIPTION OF THE PREFERRED EMBODIMENTS

The present invention pertains to a process for inhibiting aluminum hydroxide deposition in a felt in a press section of a papermaking system wherein the felt is prone to such deposition and the felt is conditioned by showering with an aqueous medium, which comprises adding to the aqueous medium an effective inhibiting amount of a hydroxylated carboxylic acid having at least one hydroxyl group and at least two carboxyl groups. The carboxylic acids can be further characterized in that they are low molecular weight, hydroxylated di- or tri-carboxylic acids containing from about 3 to about 6 carbon atoms. Furthermore, the carboxylic acids of this invention generally have a molecular weight of from about 100 to about 200. Exemplary carboxylic acids include: tartaric acid (2-3-dihydroxybutanedioic acid); malic acid [hydroxy-methylmalonic(propanedioic)acid]; citric acid (2-hydroxy-1,2,3-propane tricarboxylic acid); mesoxalic acid [dihydroxy malonic(propanedioic)acid]; tartronic acid [hydroxy malonic(propanedioic)acid]; and tetrahydroxy succinic(butanedioic)acid. Preferably, the carboxylic acid is selected from the group consisting of tartaric acid, malic acid and citric acid.

The carboxylic acids of this invention are a limited class of compounds which have chemical and structural features that provide unexpected efficacy in inhibiting aluminum hydroxide deposition in the felts of papermaking systems. For example, it is believed that the hydroxylation feature (particularly in relationship to the compounds' relatively low molecular weight) is responsible for the unique reactivity of these compounds toward aluminum hydroxide via hydrogen bonding forces resulting in their rapid adsorption. Also, it is believed that the multiple carboxylation feature (particularly in relationship to the compounds' relatively low molecular weight) is responsible for these compounds' relatively high anionic charge density and their resulting unique ability to disperse and/or solubilize aluminum hydroxide via a ligand exchange mechanism. Additionally, these carboxylic acids have sufficiently low pka's and it is believed that this feature allows the multiple carboxyl groups of these compounds to be sufficiently deprotonated in the necessary application pH range to produce their necessary anionic charge density. Furthermore, it is believed that the relatively low molecular weight of these carboxylic acids aids the reactivity of these compounds and also produces their high performance at minimum ratios of compound weight to aluminum hydroxide weight.

One of the most critical technical requirements of controlling aluminum hydroxide deposition directly in the press felts via a felt conditioning application is that both the aluminum hydroxide controlling component and the organic deposit controlling components of the felt conditioner must be capable of acting within the time frame of seconds. This is due to the fact that the distance of felt travel between the felt conditioner application points (usually a shower from which the aqueous medium is sprayed) and the felt suction (uhle) box is only within several tens of feet and, at machine speeds of up to several thousand feed per minute, this only leaves a response time on the order of seconds before the bulk of the felt conditioner components (along with any solubilized contaminants) are removed from the felt at the suction box. This technical requirement of controlling aluminum hydroxide deposition directly in the press felts may be contrasted to an aluminum hydroxide control application prior to sheet formation (i.e., in the paper stock system) where many other agents, possibly functioning through other mechanisms, may be effective because of the available response time which may be on the order of minutes to hours. The low molecular weight, hydroxylated, di- or tri-carboxylic acids of this invention were found to possess the necessary property of rapid reactivity.

The rapid reactivity feature of this invention also distinguishes this process from the well-established practice of utilizing functionally similar chelating or complexing agents in alkaline cleaning or "boil-out" solutions to remove many types of deposited salts, including metal hydroxides. In the cleaning application, a time factor of up to several hours is required due to the relatively slow kinetics associated with relatively insoluble salt dissolution and/or ligand exchange interactions. Furthermore, the latter application requires strong alkaline solution conditions to allow the complexing agents to be active, while the instant invention can function in neutral to mildy acidic conditions.

The present invention further provides an improvement in the process for conditioning of press felts in papermaking systems producing paper or paperboard from pulp suspensions containing alum (aluminum sulfate) wherein aluminum hydroxide is deposited in the felts and a surfactant is added to the aqueous medium or shower water to inhibit felt filling and compaction. It has been found by the present inventors that optimal activity of surfactants known in the art for inhibiting felt filling and compaction caused by organic contaminants, such as tacky wood pitch components or rosin size, falls within a higher pH range (≅5.5–7.5) than that traditionally employed with the use of strong acid-based felt conditioners. It further has been surprisingly found that adding these known surfactants to the aqueous medium in combination with the aforesaid hydroxylated carboxylic acids provides a superior process for inhibiting aluminum hydroxide deposition and conditioning the felts, particularly within an optimal pH range of about 5.5 to about 8.0. This improved process alleviates the drawbacks of strong acid/low pH felt conditioning methods presently utilized in the art.

Examples of surfactants which may be utilized in accordance with this invention include: octyl phenol ethoxylates:

$$C_8H_{17}—C_6H_4—O(CH_2CH_2O)_{N-1}—CH_2CH_2OH$$

where N=9–30; nonyl phenol ethoxylates:

$$C_9H_{19}—C_6H_4—O(CH_2CH_2O)_{N-1}—CH_2CH_2OH$$

where N=9–40; dodecyl phenol ethoxylates:

$$C_{12}H_{25}—C_6H_4—O(CH_2CH_2O)_{N-1}—CH_2CH_2OH$$

where N=9–40; primary alcohol ethoxylates:

$$CH_3—(CH_2)_x—CH_2O(CH_2CH_2O)_{N-1}—CH_2CH_2OH$$

where N=12–30 and X=10–13; secondary alcohol ethoxylates:

$$\begin{matrix} CH_3(CH_2)_x \\ \\ CH_3(CH_2)_y \end{matrix}\!\!\!

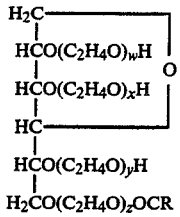

where x+y+w+z=10–30 and R=lauric, palmitic, stearic or oleic.

The amounts or concentrations of the aforesaid carboxylic acids and surfactants can vary depending on, among other things, the pH of the aqueous medium, the volume of felt shower water applied, the concentration of aluminum and the concentration of organic contaminants. While, from the disclosure of this invention, it would be within the capability of those skilled in the art to find by simple experimentation the optimum amounts or concentrations of carboxylic acid and surfactant for any particular system, generally the total amount of either the carboxylic acid or the surfactant which is added to the aqueous medium is from about 10 parts to about 1,000 parts per million parts of the aqueous medium. Preferably, both the carboxylic acid and surfactant is added in an amount from about 100 parts to about 300 parts per million. Additionally, it is preferred that the weight ratio of carboxylic acid:surfactant is from about 1:9 to about 9:1 based on the total combined weight of these two components.

The aforementioned carboxylic acids and surfactants are generally presently available commercially. These compounds can be added to the aqueous medium by any conventional method. Preferably, the pH of the aqueous medium is from about 4.8 to about 8.0 since this is the approximate range in which a sufficient quantity of insoluble aluminum hydroxide can precipitate alone or in conjunction with other substances from the aqueous medium and cause the felts to become prematurely filled and compacted. The aqueous medium can be shower water which is sprayed from shower heads onto the felts in the press section of a typical papermaking system known in the art. The aqueous medium may contain other known additives, such as deposit control agents, dispersants and solvents, which are compatible with the hydroxylated carboxylic acids and surfactants utilized in accordance with this invention.

In order to more clearly illustrate this invention, the data set forth below was developed. The following examples are included as being illustrations of the invention and should not be construed as limiting the scope thereof.

EXAMPLES

Tests were conducted to study the effect of a hydroxylated carboxylic acid (citric acid) and its salt form (sodium citrate to control aluminum hydroxide deposition. Aluminum ion in the form of alum (aluminum sulfate) was added to water to produce 104 ppm $Al^{+3}$ solution. The pH of the solution was readjusted to about 6.0 with caustic, thereby causing the aluminum to precipitate as insoluble aluminum hydroxide, which created turbidity in the solution. Citric acid and sodium citrate were added at various concentrations and the results are reported in Table I below.

TABLE I

| Aluminum Hydroxide Control Agent - ppm | | Turbidity (NTU) (104 ppm $Al^{+3}$ solution readjusted to pH 6.0) |
|---|---|---|
| Citric Acid - | 0 | 38 |
| | 50 | 44 |
| | 100 | 58 |
| | 150 | 52 |
| | 200 | 33 |
| | 250 | 13 |
| | 300 | 2 |
| | 350 | 0.4 |
| Sodium Citrate - | 200 | 58 |
| | 250 | 58 |
| | 300 | 35 |
| | 350 | 22 |
| | 400 | 9 |
| | 450 | 3 |

The results reported in Table I demonstrate that adding a sufficient amount of either citric acid or its salt form (sodium citrate) resolubilizes the aluminum, thus almost eliminating the solution turbidity. These results also demonstrate that while either the acid form or salt form can produce the desired effect, the acid form works at a significantly lower weight ratio of control agent/aluminum (3/1 for citric acid versus 4.5/1 for sodium citrate). Furthermore, the citric acid treated test solutions were observed to respond within minutes versus many hours for the sodium citrate treated solutions. Rapid response is essential in a felt conditioning application.

Additional tests were conducted utilizing a continuous felt conditioning test apparatus to study the effect of citric acid in a simulated felt conditioning application. The apparatus was comprised of an unused felt sample placed on a heavy mesh screen through which the test solutions were passed. The simulated papermaking white water test systems and treatments utilized in these tests were as follows:

Test System Conditions

| Ingredient | Concentration (ppm) | System |
|---|---|---|
| Emtal 786 (pitch) | 150 | Standard & Excess Alum |
| Filler Clay ($Al_2O_3.2SiO_2$) | 225 | Standard & Excess Alum |
| Pigment ($TiO_2$) | 75 | Standard & Excess Alum |
| Rosin Size | 225 | Standard & Excess Alum |
| Alum ($Al_2(SO_4)_3.17H_2O$) | 225 | Standard |
| Alum | 1250 | Excess Alum |
| Surfactant Inhibitors | 150 | Standard & Excess Alum |
| Citric Acid | 1250 | Excess Alum |

The results obtained are reported in Table II below.

TABLE II

Effect of Citric Acid on Felt Conditioning Performance

| | Test System 1 | 2 | 3 | 4 | 5 |
|---|---|---|---|---|---|
| Test Variables | | | | | |
| pH 4.0 | Yes | — | — | — | — |
| pH 6.0 | — | Yes | Yes | Yes | Yes |
| Standard Alum | Yes | Yes | — | — | — |
| Excess Alum | — | — | Yes | Yes | Yes |
| Nonyl phenol ethoxylate (Surfactant Inhibitor) | — | — | Yes | Yes | — |
| Citric Acid | — | — | — | Yes | Yes |
| Results | | | | | |
| Deposition in Felt: | | | | | |
| % Total Deposition | 15.8 | 9.6 | 5.7 | 2.6 | 10.9 |
| % Ash Deposition | — | — | 2.7 | 1.1 | 5.0 |

TABLE II-continued

| Effect of Citric Acid on Felt Conditioning Performance | Test System | | | | |
|---|---|---|---|---|---|
| | 1 | 2 | 3 | 4 | 5 |
| Felt Ash Analysis: | | | | | |
| % $Al_2O_3$ | — | — | 51 | 34 | 38 |
| % $SiO_2$ | — | — | 26 | 38 | 40 |
| Solution Residual Analysis: | | | | | |
| ppm Al | — | — | 0.1 | 80 | 83 |

The results reported in Table II demonstrate the unique efficacy of this invention in inhibiting aluminum hydroxide deposition in felts. Furthermore, by contrasting the results achieved with Test System 4 versus those achieved in Test Systems 3 and 5, it can be seen that the combination of citric acid (the aluminum hydroxide inhibitor) and effective organic contaminant controlling surfactants produces significantly better overall results in inhibiting felt deposition than when either component is used exclusively.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for inhibiting deposition of aluminum hydroxide in felts of a papermaking system which comprises adding to said felts in effective inhibiting amount of a hydroxylated carboxylic acid having at least one hydroxyl group and at least two carboxyl groups.

2. The process of claim 1 wherein the molecular weight of said carboxylic acid is from about 100 to about 200.

3. The process of claim 2 wherein said carboxylic acid is selected from the group consisting of tartaric acid, malic acid, citric acid, mesoxalic acid, tartronic acid and tetrahydroxy succinic acid.

4. The process of claim 3 wherein said carboxylic acid is citric acid.

5. A process for inhibiting aluminum hydroxide deposition in a felt in a press section of a papermaking system wherein the felt is prone to such deposition and the felt is conditioned by showering with an aqueous medium, which comprises adding to said medium an effective inhibiting amount of a hydroxylated carboxylic acid having at least one hydroxyl group and at least two carboxyl groups, said carboxylic acid further having a molecular weight of from about 100 to about 200.

6. The process of claim 5 wherein said carboxylic acid is added in an amount from about 10 parts to about 1,000 parts per million parts of said aqueous medium.

7. The process of claim 6 wherein the pH of the aqueous medium is from about 4.8 to about 8.0.

8. The process of claim 7 wherein said aqueous medium is shower water.

9. The process of claim 7 wherein said carboxylic acid is selected from the group consisting of tartaric acid, malic acid, citric acid, mesoxalic acid, tartronic acid and tetrahydroxy succinic acid.

10. The process of claim 9 wherein said carboxylic acid is citric acid.

11. The process of claim 9 wherein said carboxylic acid is malic acid.

12. The process of claim 9 wherein said carboxylic acid is tartronic acid.

13. The process of claim 5 or 9 further comprising adding to said aqueous medium an effective amount of a surfactant.

14. The process of claim 13 wherein said surfactant is selected from the group consisting of octyl phenol ethoxylates, nonyl phenol ethoxylates, dodecyl phenol ethoxylates, primary alcohol ethoxylates, secondary alcohol ethoxylates, propoxylated polyoxyethylene glycols, ethoxylated polyoxypropylene glycols, dialkyl phenol ethoxylates and polyoxyethylene sorbitan monoester.

15. The process of claim 14 wherein the weight ratio of carboxylic acid:surfactant is from about 1:9 to about 9:1.

16. In a process for conditioning of press felt in a papermaking system producing paper or paperboard from pulp suspensions containing alum wherein aluminum hydroxide is deposited in said felt and a surfactant is added to the shower water to inhibit felt filling and compaction, the improvement comprising adding to said water a carboxylic acid selected from the group consisting of tartaric acid, malic acid, citric acid, mesoxalic acid, tartronic acid and tetrahydroxy succinic acid, said carboxylic acid being added in an amount from 10 parts to 1,000 parts per million parts of water.

17. The process of claim 16 wherein said surfactant is selected from the group consisting of octyl phenol ethoxylates, nonyl phenol ethoxylates, dodecyl phenol ethoxylates, primary alcohol ethoxylates, secondary alcohol ethoxylates, propoxylated polyoxyethylene glycols, ethoxylated polyoxypropylene glycols, dialkyl phenol ethoxylates and polyoxyethylene sorbitan monoester.

18. The process of claim 17 wherein said water has a pH of from 4.8 to 8.0.

* * * * *